US010890043B2

(12) United States Patent
Carlsen et al.

(10) Patent No.: US 10,890,043 B2
(45) Date of Patent: Jan. 12, 2021

(54) SYSTEM FOR REMOTE OPERATION OF DOWNHOLE WELL EQUIPMENT

(71) Applicant: FMC Kongsberg Subsea AS, Kongsberg (NO)

(72) Inventors: Tor-Øystein Carlsen, Kongsberg (NO); Trond Løkka, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 35 days.

(21) Appl. No.: 15/572,773

(22) PCT Filed: May 2, 2016

(86) PCT No.: PCT/NO2016/050079

§ 371 (c)(1),
(2) Date: Nov. 8, 2017

(87) PCT Pub. No.: WO2016/182449

PCT Pub. Date: Nov. 17, 2016

(65) Prior Publication Data

US 2018/0156005 A1 Jun. 7, 2018

(30) Foreign Application Priority Data

May 8, 2015 (NO) ..... 20150570

(51) Int. Cl.

| | |
|---|---|
| ***E21B 33/043*** | (2006.01) |
| ***E21B 47/12*** | (2012.01) |
| ***E21B 33/064*** | (2006.01) |
| ***E21B 33/035*** | (2006.01) |
| ***E21B 41/00*** | (2006.01) |

(52) U.S. Cl.

CPC ..... *E21B 33/0355* (2013.01); *E21B 33/043* (2013.01); *E21B 41/0007* (2013.01); *E21B 47/12* (2013.01); *E21B 33/064* (2013.01)

(58) Field of Classification Search

None

See application file for complete search history.

(56) References Cited

U.S. PATENT DOCUMENTS 3,405,387 A 10/1968 Koomey et al.
3,680,311 A 8/1972 Harbonn et al.
(Continued)

FOREIGN PATENT DOCUMENTS

GB 1 595 529 8/1981
GB 2 448 262 B 11/2008
(Continued)

*Primary Examiner* — Matthew R Buck
*Assistant Examiner* — Douglas S Wood

(57) ABSTRACT

A remotely operated subsea well completion system, which comprises local storage (28, 36) of hydraulic energy and feedthroughs in a BOP (11) or a marine riser (9), has the object of installing or pulling a production tubing and its tubing hanger without using an umbilical within a marine riser. The system consists of an internal control module (25), which comprises hydraulic accumulators (28), a liquid divider (31), control valves (30, 34), an electric control module (27), as well as one or more transmitters/receivers (19) for communication to an external control unit (21, 26). The communication may be through acoustic feedthroughs in existing choke, kill or booster ports.

8 Claims, 3 Drawing Sheets

(56) References Cited

U.S. PATENT DOCUMENTS

| | | | | |
|---|---|---|---|---|
| 4,636,934 | A * | 1/1987 | Schwendemann | E21B 33/0355 137/624.18 |
| 8,725,302 | B2 * | 5/2014 | Niemeyer | E21B 34/045 700/282 |
| 2005/0269096 | A1 | 12/2005 | Milberger et al. | |
| 2006/0042791 | A1 | 3/2006 | Hosie et al. | |
| 2008/0202761 | A1 | 8/2008 | Trewhella | |
| 2012/0111572 | A1 | 5/2012 | Cargol, Jr. | |
| 2012/0205561 | A1 | 8/2012 | Baugh | |
| 2013/0153242 | A1 | 6/2013 | Flight et al. | |
| 2016/0305232 | A1 * | 10/2016 | Bird | E21B 47/001 |

FOREIGN PATENT DOCUMENTS

| | | | |
|---|---|---|---|
| WO | WO 02/088516 | A1 | 11/2002 |
| WO | WO 2008/074995 | A1 | 6/2008 |
| WO | WO 2014/072521 | A2 | 5/2014 |

* cited by examiner

SYSTEM FOR REMOTE OPERATION OF DOWNHOLE WELL EQUIPMENT

TECHNICAL FIELD OF THE INVENTION

The present invention relates to a system for remote control and operation of subsea well completion equipment, such as to set or pull a production tubing and associated tubing hanger in or from a wellhead or wellhead module.

More specifically, the present invention provides an arrangement and method to complete subsea wells without an umbilical connected between the marine riser and the internal work tube. This will eliminate potential damage to the umbilical cord from uncontrolled loads inside the marine riser. The invention therefore facilitates reduction or elimination of large umbilical cord drums and associated operational containers, which are space-demanding on the vessel, especially for deep-water use.

BACKGROUND OF THE INVENTION

A need exists in the petroleum industry for cost reductions with regard to underwater operations, while maintaining or increasing robustness and safety, compared to current practice. It is widely known that the construction, operation and decommissioning of offshore wells involve major investments and operational costs, especially for petroleum fields which are located in challenging waters with large water depths, high sea states and large underwater currents. Subsea production systems currently are controlled by umbilicals that normally contain hydraulic and electrical power supply and electrical and/or optical communication lines. These umbilicals are typically connected between the platform or intervention vessel and the subsea equipment. In the simplest variant, subsea installations are controlled by direct hydraulic control. Such traditional solutions to, e.g., operate well tools are seen as very reliable, but the experience is that they also have distinct challenges.

The use of hydraulic lines from the surface to the seabed requires extensive use of materials that are heavy and expensive. Larger water depths require large umbilicals to control subsea equipment mounted within, on or next to the wellhead. The hydraulic response time will be slow when the umbilical cord is long. The use and handling of such umbilicals are also challenging, and it is not unusual for the umbilicals to be damaged during use, particularly when the umbilicals are used in areas where they may be squeezed between adjacent and external equipment. An example of this is when the umbilical is used during completion of a subsea well in a so-called well completion operation. Here the hydraulically operated well tools are controlled by direct hydraulic lines from the drilling rig to the wellhead, and it is not unusual for the umbilical cord to contain 15 to 20 separate hydraulic lines. These lines are bundled together, preferably with some electrical conductors for transmitting electrical power to sensors, to form the umbilical. The outside diameter of the umbilical typically ranges from 70 mm to 100 mm. The umbilical is installed by attaching it to the work tube (e.g., with clamps). The work tube is used to install the tubing and its underwater suspension (i.e., a tubing hanger) in the wellhead or wellhead module. The work tube can be a drill string or a smaller riser—typically about 75 mm (3") to 180 mm (7") inner diameter. This assembly is lowered through the rig drill floor, where the marine riser of the rig is also connected. The marine riser is a large outer tube (535 mm (21") outside diameter) which also extends from the drilling rig to the well head, and is connected to the wellhead with a Blow Out Preventer—BOP. The umbilical is situated between the marine riser and the work tube and is in this case subject to large mechanical stresses. This is because the rig and marine riser move as a consequence of environmental loads, such as waves and sea currents.

FIG. 1 illustrates this traditional prior art situation, in which the hydraulic umbilical 7 is positioned between the marine riser 9 and the work tube 8. The marine riser is shown as the outer tube which is fully exposed to the environment, while the work tube is installed inside the marine riser. The umbilical is attached to the work tube with clamps 18, and the marine riser is shown somewhat skewed to illustrate the effect of external loads. The marine riser also has so-called flex joints/ball joints 10, 3, which are points at which the marine riser can rotate or bend for relieving stresses. However, this results in a distinct disadvantage for the umbilical, as it can easily be damaged by such rotation or bending of the marine riser. Other challenging points are the telescopic joint 4 of the marine riser and the opening in the drill floor 2, where the umbilical will experience significant wear caused by movement.

A solution to protect the umbilical can be to attach centralization clamps, which are intended to avoid too much damage to the umbilical by keeping it away from moving parts. However, the consequence of this would be that the clamps would take the substantial part of the load, and experience shows that they may detach from the work tube and fall down towards the subsea well 16 and end up inside the BOP 11. Such an event can be very costly, as such loose objects in the well must be "fished up" with time-consuming methods and the use of special equipment. Such special equipment may be that which is used in a so-called wireline operation. The rig must therefore use resources and time on unnecessary operations, which can be very costly if the operations should take a long time.

It is therefore desirable to introduce a new method for installing or pulling a subsea completion without the use of an umbilical inside the marine riser, or with the use of an umbilical whose size is minimized. The umbilical has two primary functions: (I) transfer energy in the form of electrical or hydraulic power, and (II) provide a means of communication between the central operational unit and the end function. An example of an end function may be pressure and temperature sensors, pilot operated control valves or hydraulically operated pistons.

Any new method must therefore replace these two main functions so that the planned completion can be carried out even without a controlling hydraulic umbilical cord. The present approach presents an alternative method in which the well tool is operated with locally stored hydraulic energy but is controlled remotely by means of feedthroughs in the lower marine riser 9 or the BOP 11.

With very few exceptions, a BOP has multiple feedthroughs located close to the safety valves. These are actively used in well control situations where some of these feedthroughs are connected to smaller external tubes—so-called "choke and kill" lines. The production tubing must be oriented when it is suspended in the wellhead or wellhead module to facilitate subsequent operation. The openings in the BOP are used in connection with this by inserting an activatable rotational pin into one of the openings which engages with a helix when the production tubing is being suspended in the wellhead.

Likewise, such a feedthrough may be used to insert a remotely operated communication unit that controls the functions of the well completion tool. The communication unit may be an acoustic, light or radio wave transmitter or other suitable means for communicating in the medium contained in the main bore of the BOP and/or the marine riser. It is possible to place containers of hydraulic power and associated control valves on the work tube above the downhole tool, or on the downhole tool proper, which is used to suspend the production tubing in the wellhead or wellhead module. Containers with hydraulic energy are also known as accumulators, where internal gas creates a pressure in a hydraulic fluid.

Alternative methods to reduce the size of or eliminate the umbilical inside the marine riser are described in the patent publications NO334934, GB2448262B, US2005269096A1 and US2008202761A1. All of these solutions depend on energy to actuate the operations coming from the vessel or rig at the surface. None of these publications shows a solution which utilizes locally stored hydraulic energy located inside the BOP/marine riser, close to the well tool, where the communication and control is carried out with feedthroughs in the BOP or marine riser.

US 2012/205561 shows an underwater LMRP control system (local control module) arranged in-line and below a flex joint and a riser, wherein at least one accumulator for local storage of energy is provided either in the LMRP control system or the BOP stack directly above a wellhead (see FIGS. 1, 2 and paragraphs [0036], [0039]). This arrangement further comprises an external umbilical cord on the outside of the riser for communication and remote control to and from an operating surface vessel and internal pressure control valves.

US 2006/042791 discloses a system and methods for completing operations of a subsea wellhead, wherein the protection of the umbilical during completion operations is a major objective (see paragraph [0008] and [0022]). FIGS. 2 to 3 show feedthroughs between an inner tube and a marine riser, through which cables of umbilicals can pass (see paragraph [0025]). This reference further discloses the use of an ROV (FIG. 5) for direct communication or wireless communication (FIG. 6) from the surface to the subsea well tool.

All of these prior art arrangements depend on energy for actuation of the operations coming from the surface rig or vessel. The present invention has as its main objective the avoidance of such transfer of energy from the surface.

BRIEF DESCRIPTION OF THE DRAWINGS

The invention will now be described with reference to the accompanying drawings, in which.

DETAILED DESCRIPTION

Figure 1:
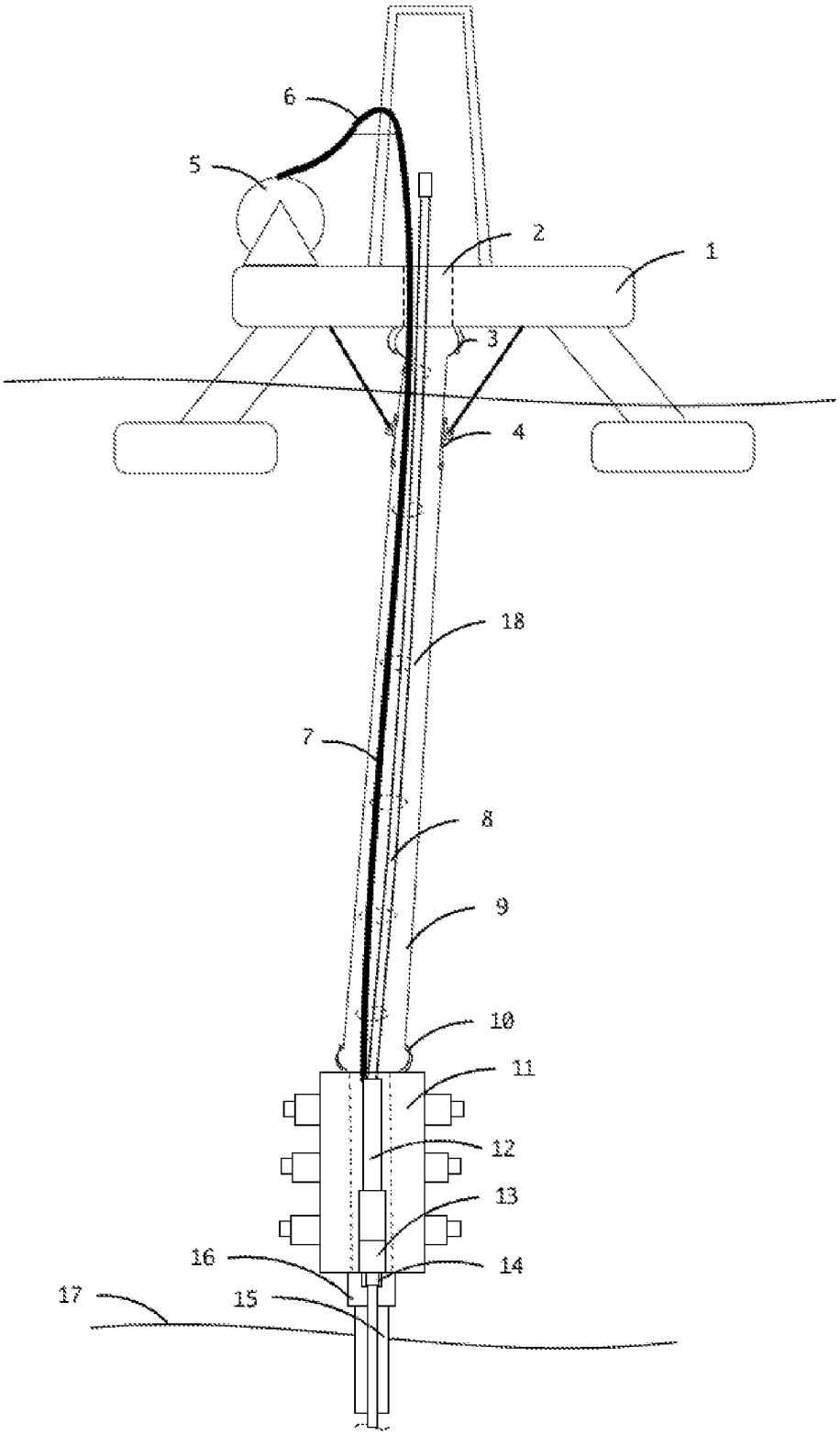
FIG. 1 shows a prior art conventional well completion operation.
Figure 2:
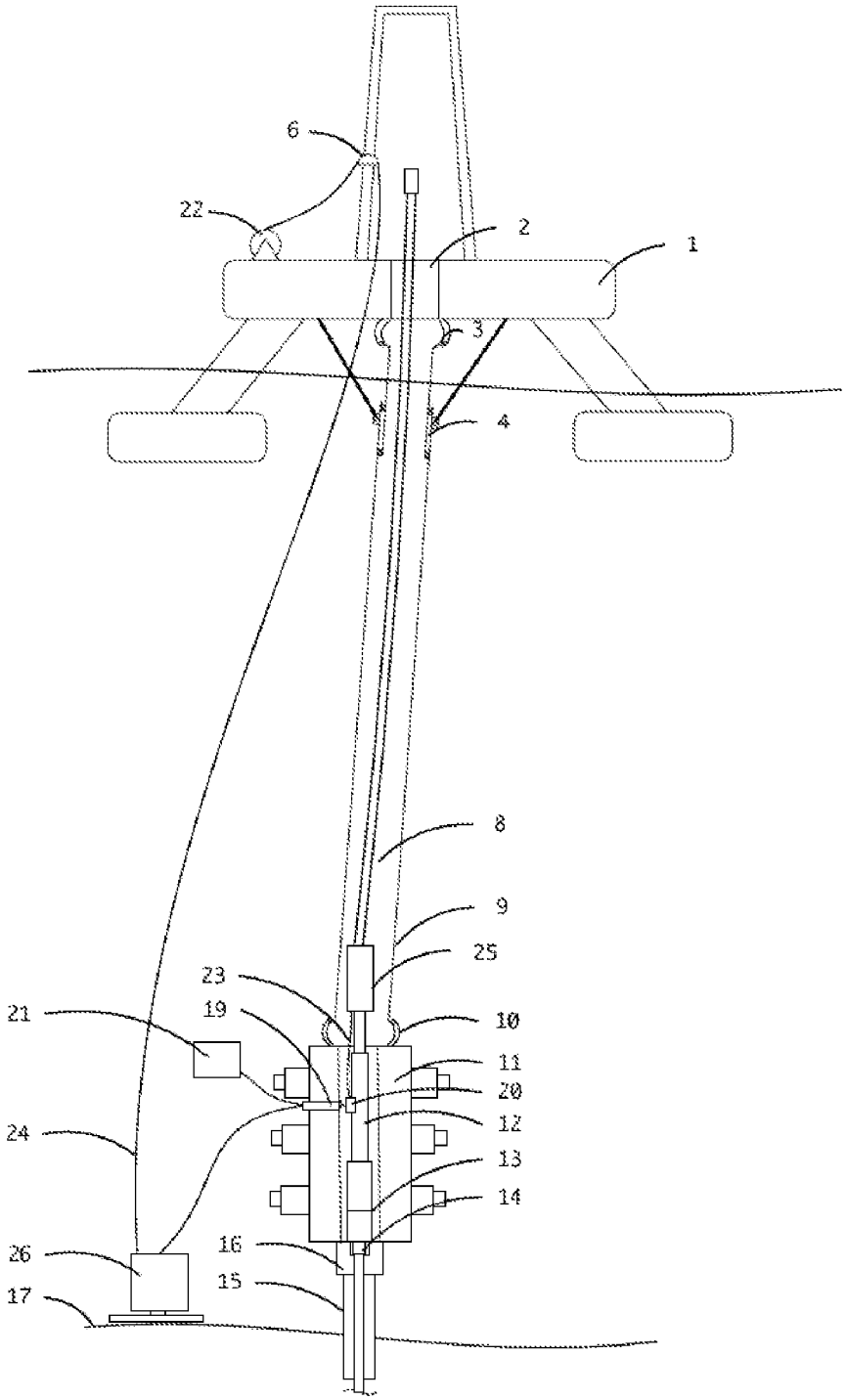
FIG. 2 illustrates a well completion operation of the invention.

FIG. 2 shows a principle sketch of the invention set in a larger system containing a rig 1, a marine riser 9, a BOP 11, a wellhead 16, a production tubing 14, a work tube 8, a lower landing string 12 and a well tool 13. A local control module 25 is placed on the work tube 8 or in the upper part of the landing string 12. This control module is able to operate the well tool 13, which is configured to suspend or pull tubing and to lock the tubing to the wellhead 16 or a wellhead module. Such a wellhead module may be a valve tree (also known as Christmas tree), which contains production valves to control the production of oil and gas.

The downhole tool 13 is also known in the industry as a Tubing Hanger Running Tool (THRT) and can be hydraulically operated. It is also possible to control deep set functions further down in the well using the landing string 12 and the well tool 13, such as a Down Hole Safety Valve (DHSV), production zone valves, formation isolation valves, gas lift valves, or sensors. A landing string may also contain local safety valves and a disconnect module for shutdown of the well stream. The combination of the landing string valves and the disconnect module is known in the industry as a subsea test tree. The control module will in this system provide the necessary hydraulic energy to operate the desired functions, thus replacing the current supply through the umbilical 7. It is therefore essential to the invention that the control module contains a hydraulic power source and a method of controlling the hydraulic power source for carrying out the end functions.

A traditional umbilical cord 7 may also include means for communication. Consequently, the present invention must be able to replace this. FIG. 2 shows an implementation of the blowout preventer which includes a communication means 19. This communication means may advantageously be an acoustic transmitter which transmits signals to an internal receiver (20) located on the internal landing string 12 or the work tube 8, but may also be any other devices that exchange communications using generated waves, e.g., light, ultrasound or radio waves. The receiver may be oriented relative to the transmitter by rotating the landing string and tubing hanger when the assembly is being landed into the wellhead or wellhead module. Often, a helix formed on the landing string or tubing hanger is used for this purpose.

The transmitter 19 will sometimes be exposed to high pressure on one side (inside the BOP) and hydrostatic water pressure on the other side (exterior of the BOP). Consequently, the transmitter must be able to withstand a relatively high differential pressure, which is known in the industry per se. Generally, devices for such a feedthrough of power or communications are referred to as "penetrators". It would not be appropriate to use penetrators, which slide in for activation, as this will require precise tolerances between the interconnected mechanical parts. The transmitter 19 and the receiver 20 should therefore be capable of a certain distance and skewing after the production tubing is landed in the wellhead or wellhead module. The same will apply if the planned operation is to pull the production tubing to replace it or to plug and shut down a subsea well.

Communications from the transmitter and receiver in the BOP to the operating vessel 1 can now be simply transferred with an individual electric and/or optic umbilical 24. Advantageously, a seabed-located central module 26, which can also control a wellhead module during completion, may be used so that the umbilical cord outside the marine riser can become a common control cable. Alternatively, communications to and from the transmitter 19 may be transferred to the operation vessel 1 by the use of an ROV 21. Most ROVs have one or more auxiliary outputs for temporarily connecting to equipment, such as the transmitter/receiver 19.

Figure 3:
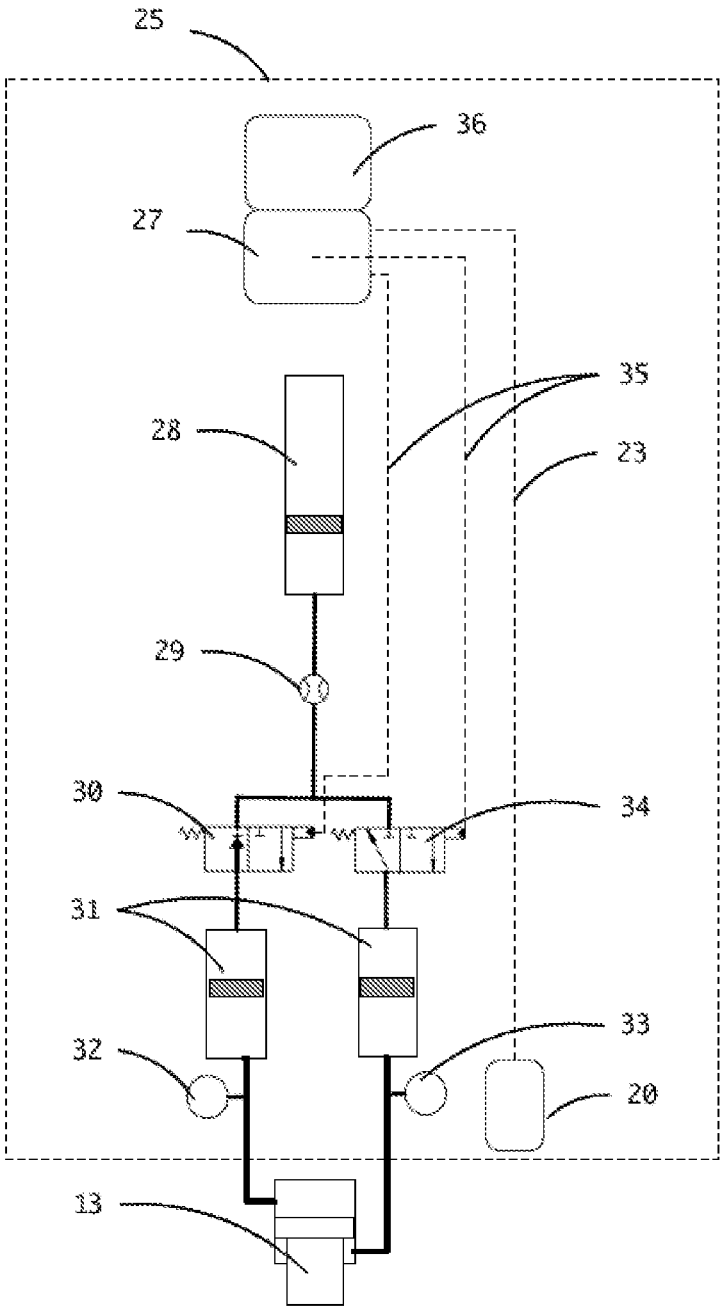
FIG. 3 shows a detailed embodiment of a local control module.

A more detailed functional layout of the control module 25 is shown in FIG. 3, which also depicts a simplified hydraulic well tool 13. Hydraulic fluid from the downhole tool and other lower well functions may be contaminated with small particles from the well environment that could affect the reliability of the hydraulic functions of the control module. One or more liquid separators 31 are therefore inserted for protecting more sensitive equipment, such as control valves 30, 34. One or more hydraulic accumulators 28 are shown as local storage of energy for executing functions in the well tools and associated equipment, as described above.

Control valves 30 and 34 are controlled by a control module 27, which in turn is supplied, if necessary, by electric power from an electric energy source 36, which may be a battery, capacitor or other suitable electric means. A hydraulic flow meter 29 and sensors 32, 33 for measuring pressure may advantageously be included in the control module 25, as shown in FIG. 3, to monitor the condition of the system.

FIG. 3 also shows that the communication receiver 20 is connected to the control module 27 using a suitable conductor 23. It will be obvious to the operator to replace the local electrical energy source 36 and communication receiver 20 with a simplified electrical umbilical installed in the traditional manner along the work tube 8. This has a clear disadvantage in that the electrical umbilical cord may be damaged as described above. The benefit of the simplified electrical umbilical is that an electrical umbilical cord is significantly smaller in diameter as compared with a hydraulic umbilical, typically half the diameter.

Operational Steps:

The system is operated by lifting the downhole tool 13 up to the drill floor 2 with the landing string 12. The landing string is then hung off from the drilling deck while still connected to the production tubing 14, which at this time is partly run into the wellbore. The control module 25 is hoisted up to the drill deck and lowered onto the well tool 13. A test unit for the control module 25 is then connected to control the operation of the control module while on the drill floor. The module 25 drives the locking function of the downhole tool 13 so that the tool is locked to the production tubing. Other functions are tested, such as tubing hanger functions, deep-set well functions and any sensors mounted on the tubing. Then the downhole tool 13 is lifted up together with the production tubing and hanger 14. During the lowering of the production tubing, hydraulic pressure is applied on the well tool 13 lock function. This is to prevent the production tubing from being dropped into the well during running.

When the production tube approaches the suspension point in the wellhead 16, it is lowered slowly onto a wellhead shoulder. Now the acoustic transmitter (19) and receiver 20 will be within range and communication will be achieved through the underwater module 26 or ROV 21.

The control module 25 now communicates via the subsea module 26 and cable 24 up to the rig or operating vessel. Here the control module will be operated from a test station with the necessary control programs.

When the tubing hanger 14 has been suspended, a locking feature is pressurized so that the tubing is locked in the well on the shoulder at which the production tubing is hung off. Then, relevant seals are tested by pressure tests and any downhole hydraulic and electric functions are tested and is operated as needed. All of this activity is controlled and supplied from the control module 25 via its hydraulic and electrical functions.

The downhole tool 13 is now disconnected from the production tubing 14, which is done by pressurizing the function for disconnect from the control module 25. The work tube 8 with the control module 25, landing string 12 and downhole tool 13 is now pulled back to the drill floor.

The invention claimed is:

1. A system for remote operation of downhole well equipment through a marine riser extending between a surface vessel and a BOP attached to a wellhead, the system comprising:

a local control module located inside one of the marine riser or the BOP, said local control module including a local energy storage device for operation of the downhole well equipment;

a remote control unit external of the BOP, said remote control unit being in communication with the vessel;

said BOP comprising at least one passage extending generally laterally therethrough in a direction generally perpendicular to a longitudinal axis of the BOP;

a communication device positioned within said passage, said communication device being in communication with said local control module;

wherein the local energy storage device comprises:

at least one hydraulic energy source;

at least one liquid divider for segregation of contaminated liquid from said downhole well equipment from clean liquid from the hydraulic energy source;

at least one control valve in fluid communication with said liquid divider and said hydraulic energy source to control the flow of clean liquid between said hydraulic energy source and said liquid divider;

at least one local electrical control module in communication with said control valve to operate said control valve; and at least one electrical energy source which supplies said local electrical control module with electric power.

2. The system according to claim 1, wherein the control module is positioned inside the marine riser.

3. The system according to claim 1, wherein said liquid divider comprises a dividing element.

4. The system according to claim 1, wherein said electric control module includes a wireless transmitter and/or receiver.

5. The system of claim 1, wherein said at least one passage through the BOP is an existing choke, kill or booster port.

6. The system according to claim 1, wherein said remote control unit is in communication with the vessel via at least one of an ROV or an umbilical arranged external of said marine riser.

7. The system according to one of claims 1-6, wherein the system is configured such that operation of the downhole well equipment is facilitated by control communications through the remote control unit and said communication device to operate said at least one control valve to use locally stored hydraulic energy in said management module to operate said downhole equipment.

8. A method for remote operation of downhole well equipment with the system of any of the claims 1-6, said remote operation including at least one of completion, intervention or shutdown of a subsea well, the method comprising:

attaching said local control module to said completion tool, and lowering said local control module with said tool through the marine riser;

actuating installation of said production tubing using energy stored in said local storage of energy in said local control module; and controlling said actuation through communication via said communication device when an upper part of the production tubing is oriented and hung off in the wellhead.

* * * * *